US009821575B2

(12) United States Patent
Nakajima et al.

(10) Patent No.: US 9,821,575 B2
(45) Date of Patent: Nov. 21, 2017

(54) SHEET CARTRIDGE, LABEL CREATION APPARATUS, AND CONTROL METHOD FOR LABEL CREATION APPARATUS

(71) Applicant: Seiko Epson Corporation, Tokyo (JP)

(72) Inventors: Kenichi Nakajima, Shimosuwa-machi (JP); Taishi Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/375,766

(22) Filed: Dec. 12, 2016

(65) Prior Publication Data

US 2017/0087888 A1 Mar. 30, 2017

Related U.S. Application Data

(63) Continuation of application No. 14/833,926, filed on Aug. 24, 2015, now abandoned, which is a continuation of application No. 13/926,294, filed on Jun. 25, 2013, now Pat. No. 9,145,008.

(30) Foreign Application Priority Data

Aug. 1, 2012 (JP) ..... 2012-171079

(51) Int. Cl.
*B41J 11/46* (2006.01)
*B41J 11/66* (2006.01)
*B41J 3/407* (2006.01)

(52) U.S. Cl.
CPC ..... *B41J 11/663* (2013.01); *B41J 3/4075* (2013.01); *B41J 11/46* (2013.01)

(58) Field of Classification Search
USPC ..... 400/583
See application file for complete search history.

(56) References Cited

U.S. PATENT DOCUMENTS 3,515,270 A 6/1970 Yang et al.
4,214,024 A 7/1980 Jacobson
(Continued)

FOREIGN PATENT DOCUMENTS

CN 101157308 A 4/2008
JP 63-189274 A 8/1988
JP 2006-297677 A 11/2006
JP 2011-178147 A 9/2011

OTHER PUBLICATIONS

Non-Final Office Action received in U.S. Appl. No. 13/926,294, dated Sep. 17, 2014.
(Continued)

*Primary Examiner* — Jill Culler
(74) *Attorney, Agent, or Firm* — ALG Intellectual Property, LLC

(57) ABSTRACT

A sheet cartridge includes a label sheet and a cartridge case. The label sheet has plural label portions temporarily attached at a predetermined label pitch to a temporary label attachment area that is one end in a direction of width of a long backing sheet, and plural label position detection target portions provided at a detection target end portion that is an other end in a direction of width of the backing sheet and configured to indicate a print start position and a cutting position for the each label portion. The cartridge case accommodates the label sheet that is wound, in such a way that the label sheet can be reeled off, and in which cartridge case a detection opening for protruding each label position detection target portion for detection is formed.

13 Claims, 11 Drawing Sheets

(56) References Cited

U.S. PATENT DOCUMENTS

| | | | | |
|---|---|---|---|---|
| 4,457,964 | A | 7/1984 | Kaminstein | |
| 5,157,415 | A * | 10/1992 | Seyasu | B41J 25/316 347/197 |
| 7,686,527 | B2 | 3/2010 | Harada et al. | |
| 2006/0013634 | A1 | 1/2006 | Harada et al. | |
| 2006/0159508 | A1 | 7/2006 | Mori et al. | |
| 2006/0165467 | A1 | 7/2006 | Kawakami et al. | |
| 2007/0009306 | A1 | 1/2007 | Harada et al. | |
| 2007/0041772 | A1 | 2/2007 | Harada et al. | |
| 2011/0217108 | A1 | 9/2011 | Imamura et al. | |

OTHER PUBLICATIONS

Final Office Action received in U.S. Appl. No. 13/926,294, dated Feb. 9, 2015.
Advisory Action received in U.S. Appl. No. 13/926,294, dated Apr. 30, 2015.
Notice of Allowance and Notice of Allowability received in U.S. Appl. No. 13/926,294, dated May 22, 2015.
Non-Final Office Action received in U.S. Appl. No. 14/833,926, dated Oct. 8, 2015.
Final Office Action received in U.S. Appl. No. 14/833,926, dated Feb. 17, 2016.
Non-Final Office Action received in U.S. Appl. No. 14/833,926, dated Jun. 6, 2016.
Final Office Action received in U.S. Appl. No. 14/833,926, dated Sep. 12, 2016.

* cited by examiner

SHEET CARTRIDGE, LABEL CREATION APPARATUS, AND CONTROL METHOD FOR LABEL CREATION APPARATUS

CROSS-REFERENCE

The present application is a continuation application of U.S. patent application Ser. No. 14/833,926 filed on Aug. 24, 2015, which is a continuation application of U.S. patent application Ser. No. 13/926,294 filed on Jun. 25, 2013 (now U.S. Pat. No. 9,145,008), which claims priority from Japanese Patent Application No. 2012-171079 filed Aug. 1, 2012, each of which is expressly incorporated by reference herein.

BACKGROUND

1. Technical Field

The present invention relates to a sheet cartridge, a label creation apparatus and a control method for a label creation apparatus, configured to print on each label portion while feeding a label sheet having plural label portions provided on a long backing sheet like a die cut label sheet, and to cut the label sheet on rear side of each printed label portion.

2. Related Art

According to the related art, a label creation apparatus is known which includes: a cartridge loading section where a sheet cartridge accommodating a label sheet having plural label portions provided on a long backing sheet is loaded; a feeding section which reels off and feeds the label sheet from the sheet cartridge; a printing section which performs printing on each label portion of the label sheet that is sequentially fed within the sheet cartridge; a cutting section which cuts the backing sheet on rear side in a feeding direction with respect to each printed label portion that is fed out of the sheet cartridge; a detection section which is provided downstream in the feeding direction from the cutting section and detects passage of each label position detection target portion of the label sheet that is sequentially fed; and a control section which controls the printing section based on the detection of the passage of each label position detection target portion by the detection section so as to start printing on each label portion from a planned print start target position, and also controls the feeding section based on the detection of the passage of each label position detection target portion by the detection section so that the backing sheet is cut at a planned cutting target position with respect to each label portion (see, for example, JP-A-2011-178147).

For the label sheet accommodated in the sheet cartridge of such a label creation apparatus, it is preferable that the space between the planned cutting target position for each label portion and the planned print start target position for the subsequent label portion (cut-print space) is set to the shortest possible length in order to reduce the space between label portions and thus increase the number of label portions per unit length. This cut-print space needs to be equivalent to at least the separation distance between the printing section and the cutting section in the feeding direction in the label creation apparatus, plus the distance by which the label sheet is fed until each label position detection target portion reaches the detection section after the feeding is started (detection feed distance).

However, if the detection section is provided downstream in the feeding direction from the cutting section, as in the related-art technique, the detection feed distance is longer by that amount (see FIG. 10 of JP-A-2011-178147). Therefore, the cut-print space becomes longer and the space between label portions becomes longer.

Thus, in order to reduce the detection feed distance, providing the detection section between an outlet of the sheet cartridge and the cutting section may be considered. However, with such a configuration, the separation distance between the printing section and the cutting section is increased in order to secure the installation space for the detection section. Therefore, the cut-print space cannot be reduced after all.

SUMMARY

An advantage of some aspects of the invention is to provide a sheet cartridge, a label creation apparatus and a control method for a label creation apparatus for starting printing at a planned print start target position and cutting at a planned cutting target position with respect to each label portion of a label sheet on which the space between label portions is minimized.

An aspect of the invention is directed to a sheet cartridge including: a label sheet having plural label portions temporarily attached at a predetermined label pitch to a long backing sheet, and plural label position detection target portions provided at a detection target end portion that is one end in a direction of width of the backing sheet and configured to detect a print start position and a cutting position for each label portion; and a cartridge case which accommodates the label sheet that is wound, in such a way that the label sheet can be reeled off, and in which a detection opening for exposing each label position detection target portion for detection is formed.

In this case, it is preferable that the plural label position detection target portions are formed by plural protruding portions that are formed by projecting the backing sheet in the direction of width of the backing sheet at the detection target end portion, and that each protruding portion is provided at a position coincident with each label portion in a longitudinal direction of the backing sheet.

Another aspect of the invention is directed to a label creation apparatus having a sheet cartridge loaded therein. The sheet cartridge includes: a label sheet having plural label portions temporarily attached at a predetermined label pitch to a long backing sheet, and plural label position detection target portions provided at a detection target end portion that is one end in a direction of width of the backing sheet and configured to detect a print start position and a cutting position for each label portion; and a cartridge case which accommodates the label sheet that is wound, in such a way that the label sheet can be reeled off, and in which a detection opening for exposing each label position detection target portion for detection is formed. The label creation apparatus controls printing on and cutting of each label portion, based on a result of detection of the label position detection target portion. The label creation apparatus includes: a cartridge loading section where the sheet cartridge is loaded; a feeding section which reels off and feeds the label sheet from the sheet cartridge; a printing section which performs printing on each label portion of the label sheet that is sequentially fed within the sheet cartridge; a cutting section which cuts the backing sheet on rear side in a feeding direction with respect to each printed label portion that is fed out of the sheet cartridge; a detection section which detects passage of each label position detection target portion of the label sheet that is sequentially fed, at a detection position facing the detection opening; and a control section which controls the printing section based on the detection of the passage of each label position detection target portion by the detection section so as to start printing on each label portion from a planned print start target position, and also controls the feeding section based on the detection of the passage of each label position detection target portion by the detection section so that the backing sheet is cut at a planned cutting target position that is on rear side of each label portion.

Still another aspect of the invention is directed to a control method for a label creation apparatus. The label creation apparatus has a sheet cartridge loaded therein. The sheet cartridge includes: a label sheet having plural label portions temporarily attached at a predetermined label pitch to a long backing sheet, and plural label position detection target portions provided at a detection target end portion that is one end in a direction of width of the backing sheet and configured to detect a print start position and a cutting position for each label portion; and a cartridge case which accommodates the label sheet that is wound, in such a way that the label sheet can be reeled off, and in which a detection opening for exposing each label position detection target portion for detection is formed. The label creation apparatus controls printing on and cutting of each label portion, based on a result of detection of the label position detection target portion. The control method includes: reeling off and feeding the label sheet from the sheet cartridge; detecting passage of each label position detection target portion of the label sheet that is sequentially fed, at a detection position facing the detection opening; printing on each label portion of the label sheet that is sequentially fed within the sheet cartridge, based on the detection of the passage of each label position detection target portion so as to start printing on each label portion from a planned print start target position; and cutting the backing sheet on rear side in a feeding direction with respect to each printed label portion that is fed out of the sheet cartridge, based on the detection of the passage of each label position detection target portion so that the backing sheet is cut at a planned cutting target position that is on rear side of each label portion.

According to this configuration, the plural label position detection target portions are provided at the detection target end portion of the label sheet, and the detection opening for exposing each label position detection target portion of the label sheet that is reeled off is formed in the cartridge case. At the detection position facing the detection opening, the detection section detects the passage of each label position detection target portion. Therefore, the detection section need not be provided downstream in the feeding direction from the cutting section that carries out cutting of each printed label portion that is fed out of the sheet cartridge, and the distance by which the label sheet is fed until each label position detection target portion reaches the detection section after the feeding is started (detection feed distance) is not elongated. Also, the detection section need not be provided between the outlet of the sheet cartridge and the cutting section. Therefore, the space between the planned cutting target position for each label portion and the planned print start target position for the subsequent label portion (cut-print space) can be reduced. Thus, printing can be started at the planned print start target position and cutting can be carried out at the planned cutting target position with respect to each label portion of the label sheet on which the space between label portions is minimized.

It is preferable that the above sheet cartridge is loaded in a cartridge loading section of a label creation apparatus which prints on the label portion, and that the detection opening of the cartridge case is provided on the side of an open-close cover that opens and closes the cartridge loading section.

It is preferable that the above label creation apparatus further includes an open-close cover that opens and closes the cartridge loading section, and that the detection section is provided on a back side of the open-close cover and moves to the detection position as the open-close cover closes.

According to this configuration, even in the case where the open side of the cartridge loading section is the detection position, since the detection section is provided on the open-close cover, the detection section retreats from the detection position as the open-close cover opens when the sheet cartridge is attached or removed. Therefore, the detection section does not obstruct the attachment and removal of the sheet cartridge. By closing the open-close cover after the sheet cartridge is installed, the detection section can be moved to the detection position.

In the above label creation apparatus, it is preferable that the plural label position detection target portions are formed by plural protruding portions formed by projecting the backing sheet in a direction of width of the backing sheet at the detection target end portion, and that the detection section, at the detection position, is located in a space between the protruding portions with respect to the label sheet with the planned cutting target position reaching the cutting section.

When the detection section moves to the detection position by the closure of the open-close cover, there is a risk that the detection section may strike a protruding portion at the detection target end portion and consequently the protruding portion may become off the detection section. However, according to the present configuration, since the detection section is located in the space between the protruding portions with respect to the label sheet with the planned cutting target position reaching the cutting section, even in the case where the open-close cover opens after the cutting and then closes again, the detection section is still located in the space between the protruding portions. Therefore, when the open-close cover is closed and the detection section moves to the detection position, the detection section does not strike the protruding portion of the label sheet. When the label sheet is fed, each label position detection target portion can be made to pass the detection section securely.

In the above sheet cartridge, it is preferable that a positioning portion for positioning a detection section which is mounted on the open-close cover in such a way that the detection section can move slightly and which detects the label position detection target portion is formed in the cartridge case.

If the open-close cover is misaligned when closing, the detection section provided on the open-close cover similarly becomes misaligned from the detection position. In such a case, printing is started with a shift from the planned print start target position and cutting is carried out with a shift from the planned cutting target position with respect to each label portion. However, according to the present configuration, since the positioning portion for positioning, at the detection position, the detection section mounted on the open-close cover in such a way that the detection section can move slightly is provided, even in the case where the open-close cover closes with a misalignment from the printing section and the cutting section, the detection section can be positioned at the detection position. Therefore, the start of printing and the cutting with a shift from the planned print start target position and the planned cutting target position due to the misalignment of the open-close cover can be prevented.

It is preferable that the above sheet cartridge further includes a platen roller which is accommodated in the cartridge case and which faces a print head of a printing section of the label creation apparatus via the label sheet provided in-between, and that the positioning portion is formed in the cartridge case at a predetermined position with respect to the platen roller.

It is preferable that the above label creation apparatus includes a mounting section where the detection section is mounted on the open-close cover in such a way that the detection section can move slightly, that the detection section is positioned by a positioning portion for positioning at the detection position, and that the positioning portion is provided at a predetermined position with respect to a platen roller which is accommodated in the cartridge case and which faces a print head of the printing section via the label sheet provided in-between.

According to this configuration, the detection section is positioned with respect to the platen roller serving as a reference of the position of printing by the printing section. Therefore, the detection section can be positioned accurately.

It is preferable that the above label creation apparatus further includes a platen shaft which rotatably supports the platen roller in a cantilevered form, and that the feeding section feeds the label sheet in such a way that the detection target end portion becomes off the platen roller toward a side opposite to a cantilever-support side, by the platen roller having a width corresponding to a width of each label portion.

According to this configuration, the feeding section rotates and feeds the label sheet, using the platen roller located at a position corresponding to each label portion fed on the side of the cantilever-support side with respect to the platen shaft. Therefore, the length of the platen shaft may be a length corresponding to the width of each label portion instead of a length corresponding to the full width of the backing sheet. The length of the platen shaft (cantilever distance) can be reduced accordingly. Thus, a pressing force from the print head can be received properly without deforming the platen shaft, and therefore print quality on each label portion can be stabilized.

In the above label creation apparatus, it is preferable that the cutting section is configured to cut in from a side opposite to the detection target end portion toward the detection target end portion, of both width ends of the backing sheet.

According to this configuration, on the backing sheet, a broad-width area where protruding portions are formed and a narrow-width area between the protruding portions are provided alternately in the longitudinal direction. Since each protruding portion is provided at a position coincident with each label portion in the longitudinal direction, the planned cutting target position for each label portion is between the protruding portions, that is, in the narrow-width area. In order to cut in the label sheet thus configured, from the side opposite to the detection target end portion of the backing sheet, the cutter may have a blade length corresponding to the narrow-width area. Therefore, the blade length of the cutter can be reduced.

In the above sheet cartridge, it is preferable that each label position detection target portion includes a first detection target portion for detecting a print start position, and a second detection target portion for detecting a cutting position, and that the first detection target portion and the second detection target portion are provided away from each other in a longitudinal direction of the backing sheet.

In the above label creation apparatus, it is preferable that each label position detection target portion includes a first detection target portion and a second detection target portion that are away from each other in a longitudinal direction of the backing sheet, and that the control section controls the printing section based on detection of passage of each first detection target portion by the detection section so as to start printing on each label portion from the planned print start target position, and controls the feeding section based on detection of passage of each second detection target portion by the detection section so that the backing sheet is cut at the planned cutting target position with respect to each label portion.

After the detection section detects the passage of a label position detection target portion, the amount by which the label sheet is fed may become inconsistent with a predetermined feeding amount. If the detection section is configured to detect the passage of a single label position detection target portion with respect to each label portion, after the detection of the passage of the label position detection target portion, the feeding amount by which the label sheet is fed until the planned cutting target position for each label portion reaches the cutting section is greater than the feeding amount by which the label sheet is fed until the planned print start target position for each label portion reaches the printing section, and therefore if there is any inconsistency in the feeding amount, particularly the shift of the cutting position from the planned cutting target position is large. However, according to the present configuration, the control section not only controls to start printing at the planned print start target position, based on the detection of the passage of the first detection target portion, but also controls to cut the backing sheet at the planned cutting target position, based on the detection of the passage of the second detection target portion after the detection of the passage of the first detection target portion. Therefore, the feeding amount by which the label sheet is fed until the planned cutting target position for each label portion reaches the cutting section can be reduced after the detection of the passage of the label position detection target portion, compared with the configuration in which the detection section detects the passage of a single label position detection target portion for each label portion. Thus, even in the case there is any inconsistency in the feeding amount, the amount of shift of the cutting position from the planned cutting target position can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings. In a label creation apparatus according to this embodiment, a sheet cartridge accommodating a so-called die cut label sheet as a label sheet having plural label portions provided on a long backing sheet is loaded. The label creation apparatus prints on each label portion while reeling off the label sheet from the sheet cartridge, and then cutting the label sheet on the rear side of each printed label portion, thus creating a sheet piece (label) on which desired printing is done.

Figure 1:
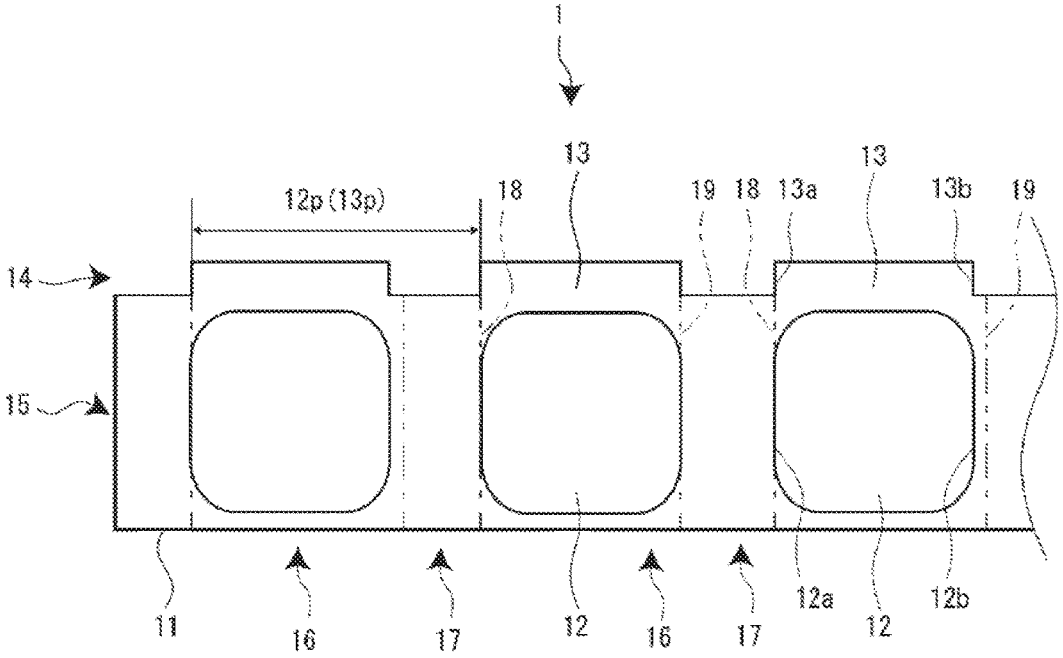
FIG. 1 is a plan view of a label sheet accommodated in a sheet cartridge of a label creation apparatus according to an embodiment of the invention.

First, a label sheet 1 will be described with reference to FIG. 1. The label sheet 1 includes a long backing sheet 11, and plural label portions 12 arrayed at a predetermined label pitch 12*p* in the longitudinal direction of the backing sheet 11. Each label portion 12 is formed in a rectangular shape with round corners and is temporarily attached to the backing sheet 11 with an adhesive on the back side.

While the plural label portions 12 are arrayed in one line on the label sheet 1 of this embodiment, label portions 12 with a narrower width may be arrayed in plural lines. Also, while the label pitch 12*p* is uniform (for example, 14 mm), non-uniform pitches may also be used. However, it is preferable that the label pitch 12*p* is a minimum necessary uniform pitch in order to minimize the space between labels. Moreover, the label sheet is not limited to the die cut label sheet. For example, a label sheet formed by attaching a long label base onto the backing sheet 11 and cutting only the label base to provide plural label portions 12 may also be used, without limiting to the die cut label sheet.

The backing sheet 11 is made of, for example, a synthetic paper with a silicon-treated surface so that the user can easily separate each printed label portion 12. The backing sheet 11 has plural label position detection target protrusions 13 formed by projecting one end portion (in FIG. 1, an upper end portion) in the direction of width of the backing sheet 11 into a rectangular shape in the direction of width of the backing sheet 11 at a detection target pitch 13*p* which is the same as the label pitch 12*p*. Each of these label position detection target protrusions 13 becomes a portion (label position detection target portion) to be detected by a photo sensor 216 (described later) of a label creation apparatus 200 when the label creation apparatus 200 prints on each label portion 12 while feeding the label sheet 1.

Each label position detection target protrusion 13 is provided at a position coincident with each label portion 12 in the longitudinal direction of the backing sheet 11. That is, in the longitudinal direction of the backing sheet 11, a protrusion forward end portion 13*a* (first detection target portion) that is a forward end of each label position detection target protrusion 13 and a forward end portion (label forward end portion 12*a*) of each label portion 12 coincide with each other, and a protrusion rear end portion 13*b* (second detection target portion) that is a rear end of each label position detection target protrusion 13 and a rear end portion (label rear end portion 12*b*) of each label portion 12 coincide with each other. However, in the longitudinal direction of the backing sheet 11, the protrusion forward end portion 13*a* and the label forward end portion 12*a* may be shifted from each other by a predetermined distance, and the protrusion rear end portion 13*b* and the label rear end portion 12*b* may be shifted from each other by a predetermined distance.

The backing sheet 11 can be divided in the direction of width into a detection target end portion 14 where the plural label position detection target protrusions 13 are formed, and a temporary label attachment area 15 excluding the detection target end portion 14. Each label portion 12 is temporarily attached to a substantially central part in the direction of width in the temporary label attachment area 15. Also, on the backing sheet 11, a broad-width area 16 where a label position detection target protrusion 13 is formed and a narrow-width area 17 situated between label position detection target protrusions 13 are provided alternately in the longitudinal direction.

As will be described in detail later, printing on each label portion 12 is started at the label forward end portion 12*a* by the label creation apparatus 200 (see FIG. 5) and the backing sheet 11 is cut on the rear side of the label rear end portion 12*b* (for example, 2.5 mm toward the rear side). That is, in the label sheet 1, the label forward end portion 12*a* of each label portion 12 is a planned print start target position 18, and the position 2.5 mm toward the rear side of each label portion 12 is a planned cutting target position 19. Of course, the positions of the planned print start target position 18 and the planned cutting target position 19 for each label portion 12 can be arbitrarily decided. Also, in the label creation apparatus 200, the setting of the planned print start target position 18 and the planned cutting target position 19 may be changed according to the setting by the user of the margin length of a margin (forward margin) from the forward end of the tape and the like.

In this embodiment, each label position detection target protrusion 13 is the label position detection target portion to be detected by the photo sensor 216 (see FIG. 4) of the label creation apparatus 200 when the label creation apparatus 200 prints and cuts each label while feeding the label sheet 1. However, the label position detection target portion is not limited to this form. For example, plural openings may be provided in a line in the detection target end portion 14 of the backing sheet 11. Also, plural black marks may be provided in a line in the detection target end portion 14 of the backing sheet 11.

Figure 2:
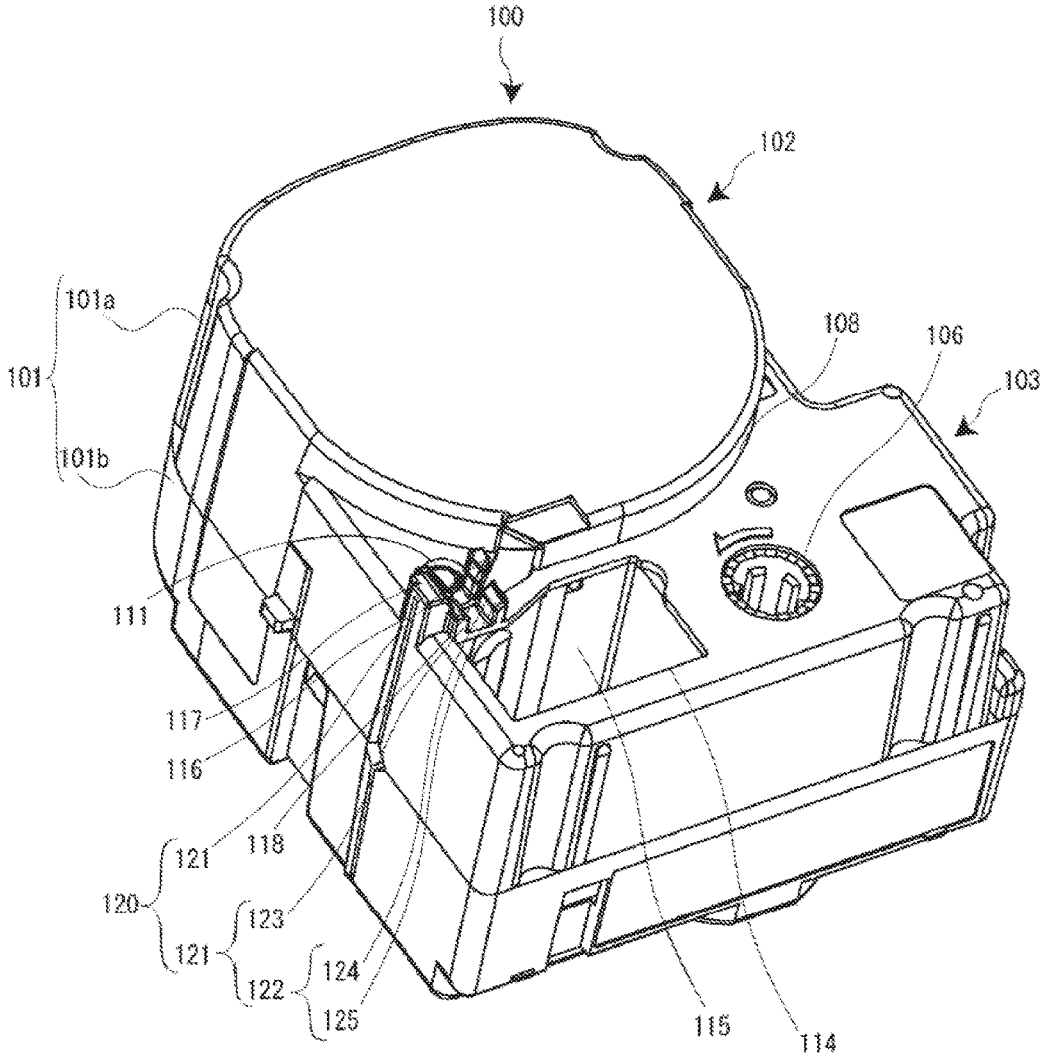
FIG. 2 is a perspective view of the sheet cartridge.
Figure 4:
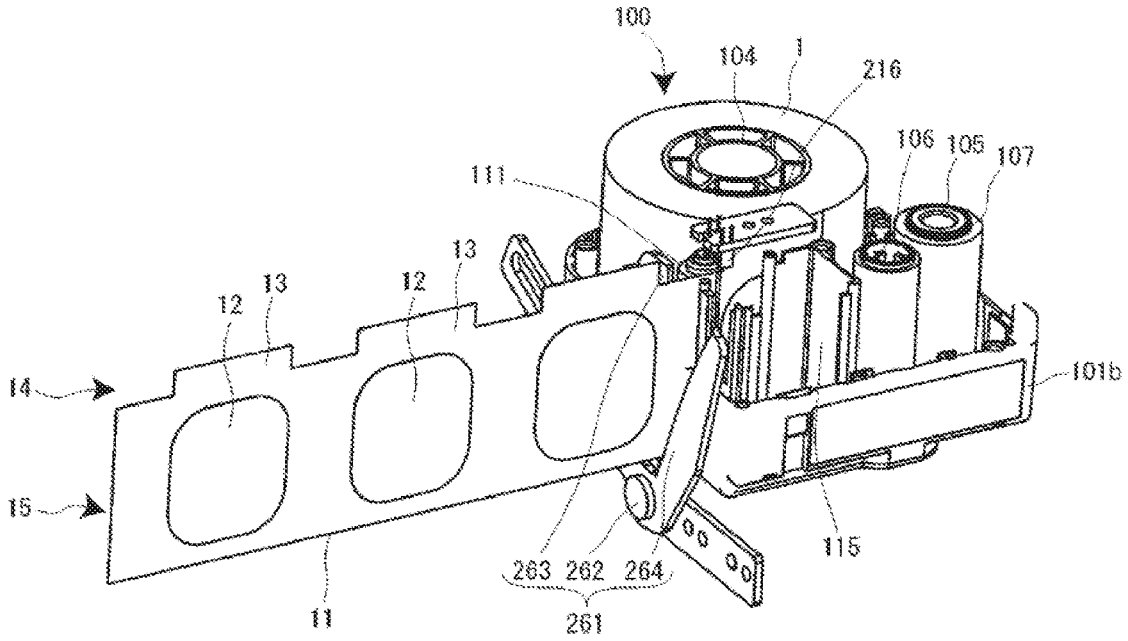
FIG. 4 is a perspective view showing the sheet cartridge with an upper case detached, and a sheet cutter and a photo sensor of the label creation apparatus.

As shown in FIGS. 2 and 4, a sheet cartridge 100 accommodating the label sheet 1 has an outer shell that is formed by a cartridge case 101 including an upper case 101*a* and a lower case 101*b* assembled together in the direction of case thickness. The cartridge case 101 can be divided into a thickly formed sheet accommodation section 102 and a ribbon accommodation section 103 that is thinner than the sheet accommodation section 102. In the sheet accommodation section 102, a sheet core 104 with the label sheet 1 wound thereon is accommodated. In the ribbon accommodation section 103, a ribbon reel-off core 105 with an ink ribbon 107 wound thereon, a ribbon take-up core 106 for taking up the ink ribbon 107, and a platen roller 111 are accommodated. The sheet core 104, the ribbon reel-off core 105, the ribbon take-up core 106 and the platen roller 111 are rotatably supported on axis protrusions or in fitting holes formed in the upper case 101*a* and the lower case 101*b*. On the sheet core 104, the label sheet 1 is wound with the detection target end portion 14 located on the upper case 101*a* side.

The platen roller 111 and the ink ribbon 107 have a width corresponding to the width of each label portion 12 (temporary label attachment area 15) of the label sheet 1. That is, the platen roller 111 and the ink ribbon 107 have a width narrower than the label sheet 1 by the amount of the width of the detection target end portion 14. In the upper case 101*a*, a step portion 108 is formed so that the ribbon accommodation section 103 becomes thinner than the sheet accommodation section 102 by the amount of the width of the detection target end portion 14.

Figure 7:
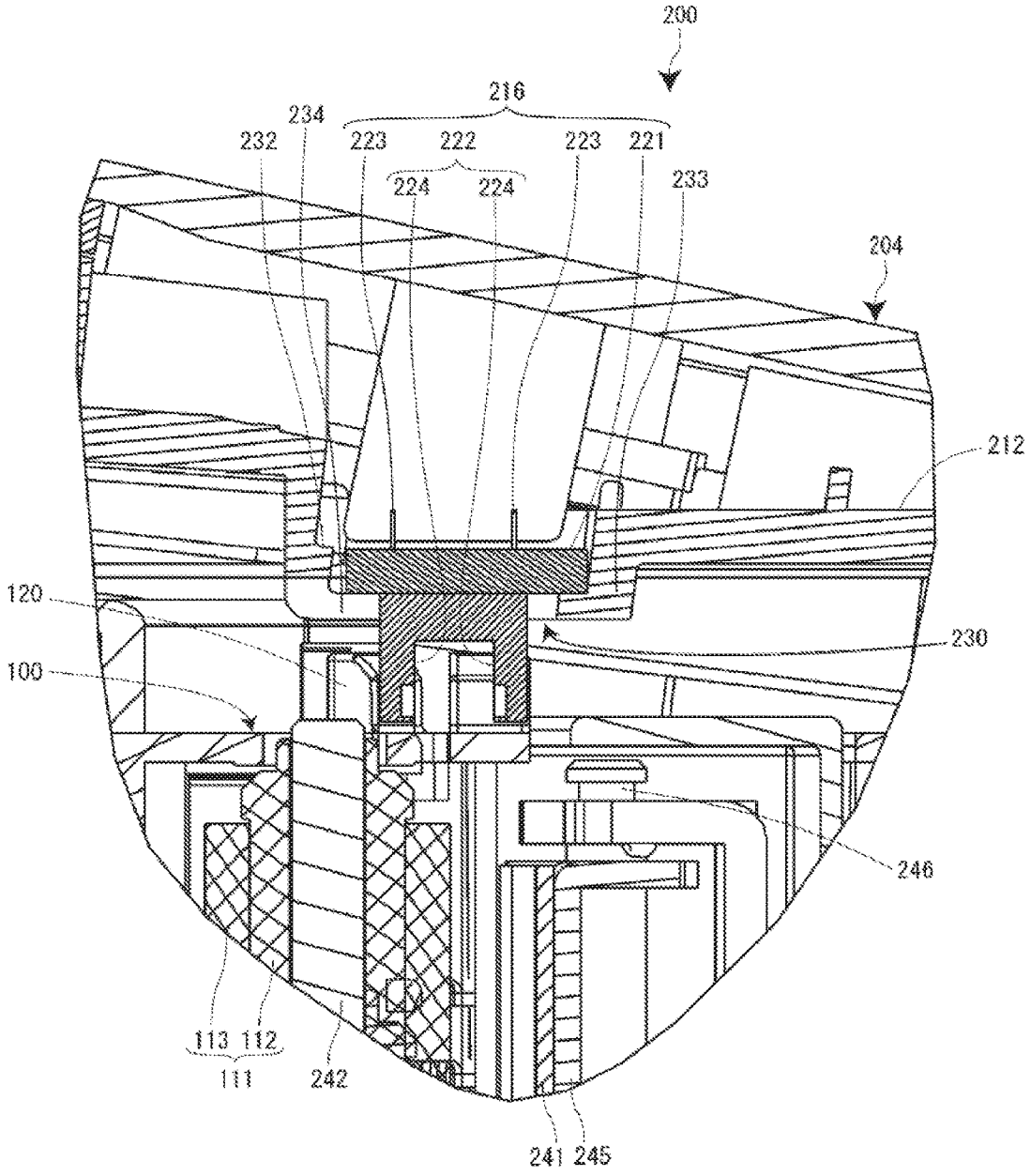
FIG. 7 is a partial sectional view showing portions around the photo sensor in the label creation apparatus with the cover being closed, taken along VII-VII in FIG. 6.
Figure 10B:
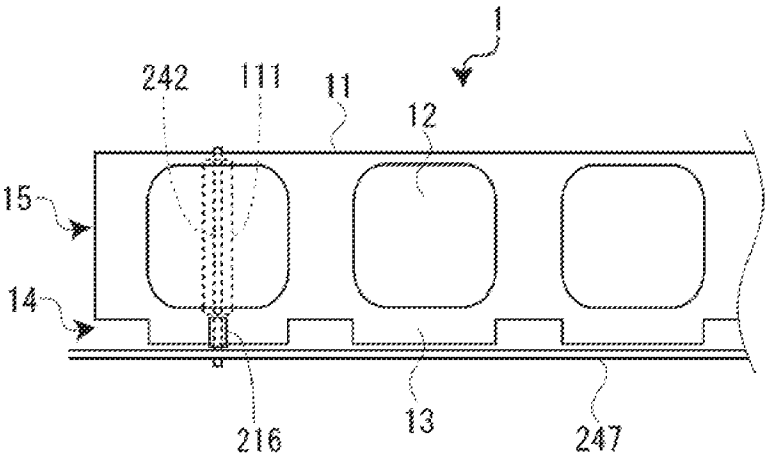
FIG. 10B shows a comparison with FIG. 10A.
Figure 10A:
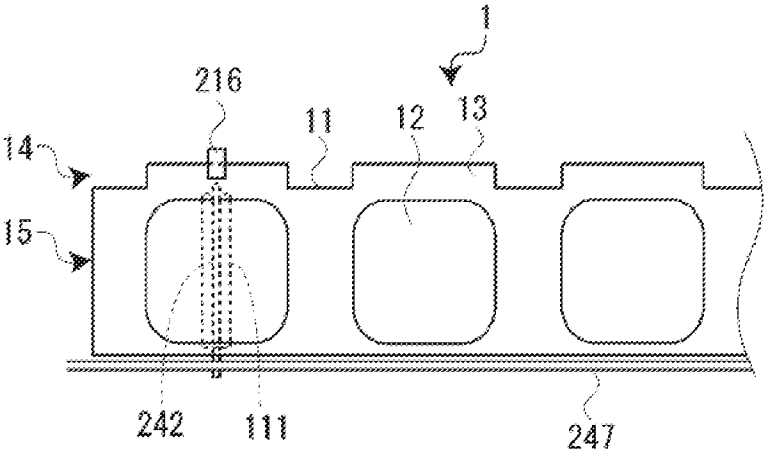
FIG. 10A illustrates the length of a platen shaft in the label creation apparatus according to the embodiment.

The platen roller 111 has a cylindrical roller main body 112, and a platen rubber 113 wound on an outer circumferential surface of the roller main body 112 (see FIG. 7). The platen roller 111 feeds the label sheet 1 in such a way that the detection target end portion 14 becomes off the platen roller 111 upward (see FIG. 10A).

In the cartridge case 101, a head opening 114 is formed in which a head cover 240 (see FIG. 5), described later, is inserted. On a bottom surface of the lower case 101*b*, a guide wall 115 which guides the feeding of the ink ribbon 107 is projected at an edge of the head opening 114.

The label sheet 1 wound on the sheet core 104 is reeled off from the sheet core 104 and reaches the platen roller 111. Meanwhile, the ink ribbon 107 is reeled off from the ribbon reel-off core 105, passes the platen roller 111, circles along an outer circumferential surface of the guide wall 115, and is taken out by the ribbon take-up core 106. Thus, the ink ribbon 107 and the label sheet 1 travel together, overlapping each other at the position of the platen roller 111. The ink on the ink ribbon 107 is stripped off in the shape of a print image and transferred onto each label portion 12.

In a left wall of the cartridge case 101, a slit-like sheet outlet 116 from which the printed label sheet 1 is sent out of the cartridge case 101 is formed. On a top surface of the upper case 101*a*, an outlet protrusion 117 is projected so that the width of the sheet outlet 116 (the length in the direction of case thickness) corresponds to the width of the label sheet 1. The sheet outlet 116 is formed including the outlet protrusion 117. Thus, the label sheet 1 does not escape upward in the sheet outlet 116.

Moreover, on the top surface of the upper case 101*a*, a slit-like detection opening 118 connected at both ends to the sheet accommodation section 102 and the sheet outlet 116 is formed between the platen roller 111 and the head opening 114. The detection opening 118 exposes each label position detection target protrusion 13 of the label sheet 1 reeled off from the sheet core 104, upward from an upper wall of the upper case 101*a*. The photo sensor 216, described later, faces this detection opening 118, and this is a detection position where the photo sensor 216 detects the passage of each label position detection target protrusion 13 on the detection target end portion 14 exposed through the detection opening 118.

In order for the photo sensor 216 to detect the passage of each label position detection target protrusion 13 at this detection position, the photo sensor 216 can be provided upstream in the feeding direction from a sheet cutter 261 which cuts each printed label portion 12 fed out of the sheet cartridge 100. The photo sensor 216 need not be provided between the sheet outlet 116 and the sheet cutter 261. Therefore, a print head 271 (see FIG. 7), described later, and the sheet cutter 261 can be arranged closely to each other, and the space between the planned cutting target position 19 for each label portion 12 and the planned print start target position 18 for the subsequent label portion 12 (cut-print space) can be reduced. Therefore, the space between label portions 12 can be minimized. Also, the forward margin can be reduced when printing on a tape is carried out (as described later).

Furthermore, on the top surface of the upper case 101*a*, a positioning portion 120 for positioning the photo sensor 216 mounted on an open-close cover 204 (see FIG. 5) in such a way that the photo sensor can move slightly, at the detection position in the feeding direction of the label sheet, is formed (as described in detail later).

Figure 5:
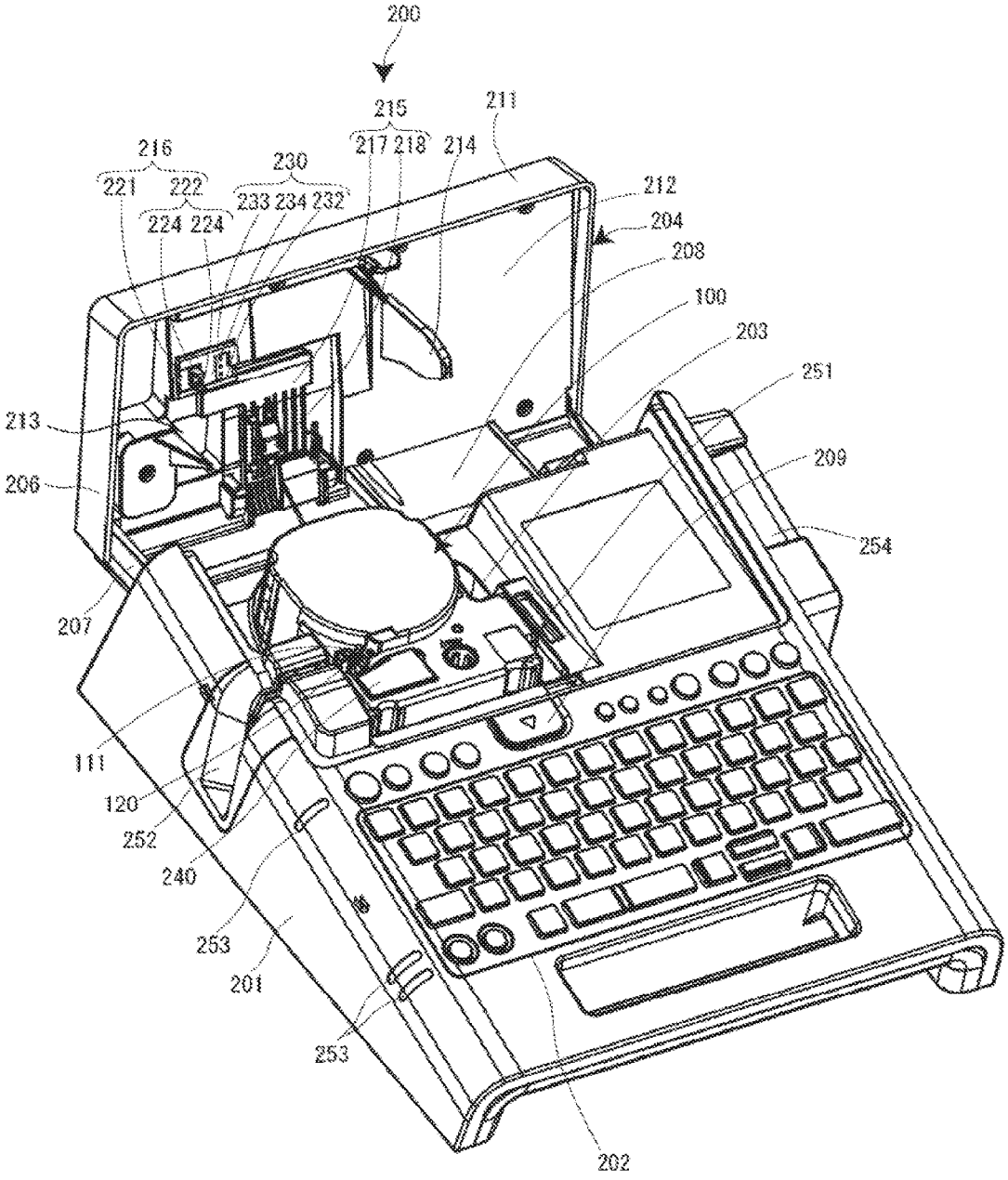
FIG. 5 is a perspective view of the label creation apparatus with the cover being open.
Figure 6:
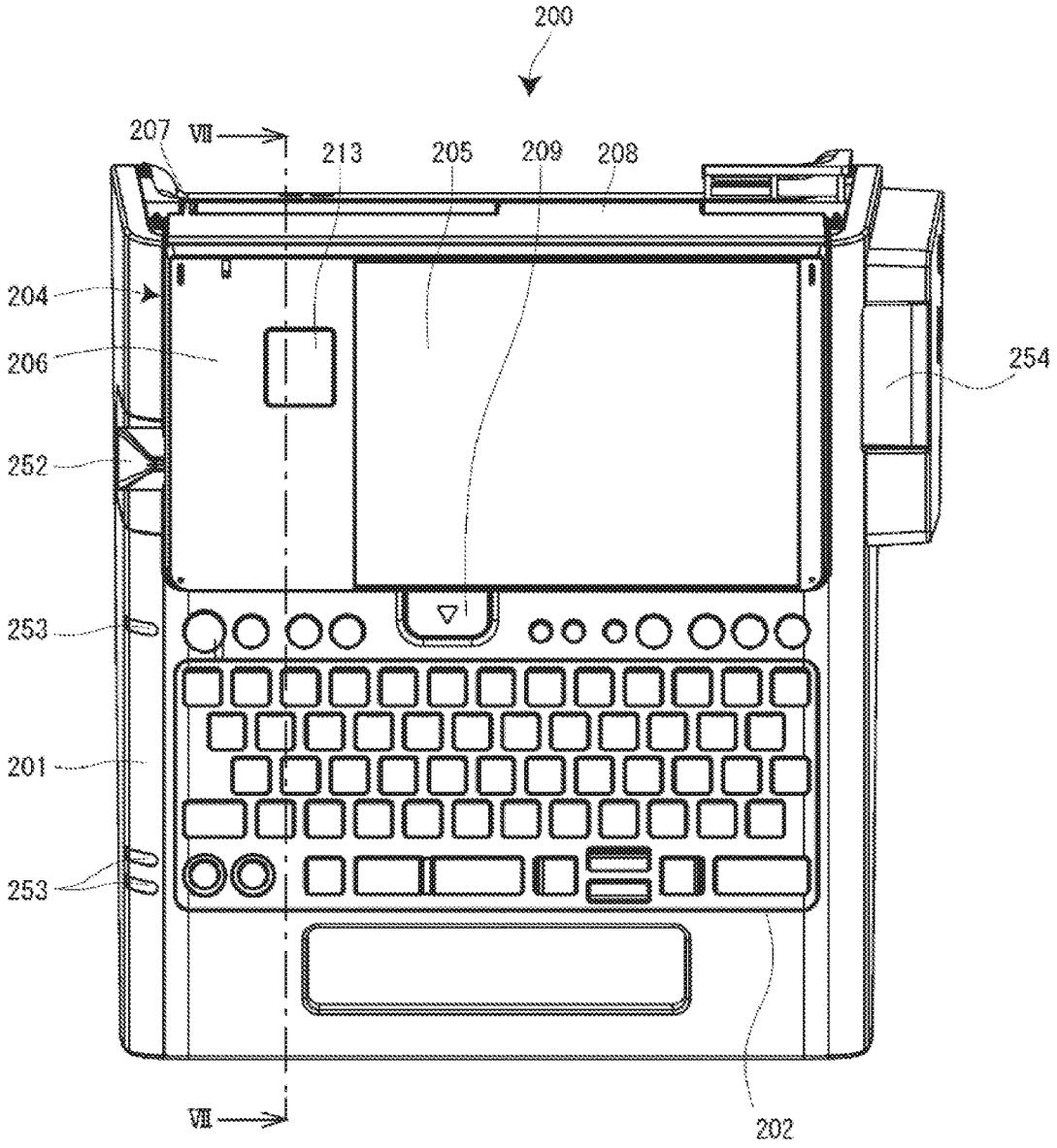
FIG. 6 is a plan view of the label creation apparatus with the cover being closed.

As shown in FIGS. 5 to 7, the label creation apparatus 200 has the above sheet cartridge 100 loaded therein in an attachable and removable manner, and the label creation apparatus 200 prints and cuts the label sheet 1. An outer shell of the label creation apparatus 200 is formed by an apparatus case 201, and a keyboard 202 having various keys is arranged in a broad area on a top surface of a forward half portion of the apparatus case 201. On a top surface of a rear half portion of the apparatus case 201, a cartridge loading section 203 where the sheet cartridge 100 is loaded in an attachable and removable manner is formed as a recess.

In the cartridge loading section 203, a tape cartridge (not shown) accommodating a tape with a separation paper can be loaded, instead of the sheet cartridge 100. As the tape cartridge, plural kinds with different thicknesses (tape widths) are prepared. In the label sheet 1 in this embodiment, the temporary label attachment area 15 is formed with the same width as the broadest tape width (for example 36 mm).

In the cartridge loading section 203, an open-close cover 204 which opens and closes the cartridge loading section 203 is provided. The open-close cover 204 includes a cover main body 206 with a built-in liquid crystal display 205, a hinge piece 207 extended on a left end portion in the rear end part of the cover main body 206, and a broad-width hinge portion 208 extended at a substantially central part in left and right direction. A hinge hole (not shown) is formed at the distal end of each of the hinge piece 207 and the hinge portion 208, and a hinge shaft (not shown) provided on the apparatus case 201 is fitted in each hinge hole, thus forming a hinge mechanism. When a cover open button 209 provided on the forward side of the cartridge loading section 203 is pressed, the cover turns upward about the hinge shaft and thus opens. The axial direction of the hinge shaft (the direction of the rotation axis of the open-close cover 204) is substantially parallel to the feeding direction of the label sheet 1. Wires (flexible flat cables and the like) led out from the liquid crystal display 205 and the photo sensor 216 pass through the hinge portion 208 and are connected to a circuit board provided inside the apparatus case 201.

An outer shell of the cover main body 206 is formed by a cover face-side wall 211 forming a face side of the open-close cover 204, and a cover back-side wall 212 covering the liquid crystal display 205 from the back side. On the cover face-side wall 211, the liquid crystal display 205 is provided over a broad area on the right, and a view window 213 to allow visual recognition of loading or non-loading of the sheet cartridge 100 is formed to the left of the liquid crystal display 205.

On the back side of the open-close cover 204, a rib-like protrusion 214 which is provided at a substantially central part and inserted into an insertion opening 251, described later, a pressing spring mechanism 215 which presses the sheet cartridge 100 when the cover is closed, toward the bottom surface of the cartridge loading section 203, and a photo sensor 216 which detects the passage of each label position detection target protrusion 13 of the label sheet 1, are provided.

The pressing spring mechanism 215 includes a large plate-like spring member 217 mounted on the open-close cover 204 and extending upward when the cover is opened, and a small plate-like spring member 218 mounted on the large plate-like spring member 217 and extending in the opposite direction (downward). A thin tape cartridge is pressed only by the large plate-like spring member 217. A thick tape cartridge and the sheet cartridge 100 are pressed by the small plate-like spring member 218 and the large plate-like spring member 217. Thus, any cartridge can be pressed at a proper position and with a proper pressing force, irrespective of the thickness of the sheet cartridge 100 or the tape cartridge.

The photo sensor 216 is a transmission-type photo sensor (photo interrupter) having a light emitting element and a light receiving element which are arranged facing each other. The photo sensor 216 includes a substantially rectangular sensor substrate 221, a sensor case 222 mounted on a bottom side of the sensor substrate 221 and accommodating the light emitting element and the light receiving element in such a way that these elements face each other, and lead wires 223 led out upward from the light emitting element and the light receiving element via the sensor substrate 221.

The sensor case 222 is formed in an inverted U-shape and has a pair of element accommodation sections 224 extending downward. When the cover is closed, the pair of element accommodation sections 224 is arrayed along the direction of thickness of the label sheet 1 that is fed. The detection target end portion 14 of the label sheet 1 passes between the pair of element accommodation sections 224 (the light emitting element and the light receiving element), and each label position detection target protrusion 13 passing there is detected. Moreover, on the cover back-side wall 212 of the open-close cover 204, a mounting section 203 for mounting the photo sensor 216 on the open-close cover 204 in such a way that the photo sensor 216 can move slightly in the feeding direction, is provided (as will be described in detail later).

The photo sensor 216 is not limited to the transmission type, and a reflection-type photo sensor can also be used. Moreover, various sensors can be used according to the form of the label position detection target portion.

In the cartridge loading section 203, a thermal-type print head 241 covered by a head cover 240, a platen shaft 242 facing the print head 241 and engaged with the platen roller 111 in the tape cartridge, a ribbon take-up shaft (not shown) which takes up the ink ribbon 107, and a guide protrusion (not shown) which guides the loading of the tape cartridge are provided upright. The print head 241 is rotatably supported on a head support shaft 246 via a head holder 245 (see FIG. 7). The platen shaft 242 is fixed at a lower end portion to a base frame 247 (see FIGS. 10A and 10B) provided on the back side of the cartridge loading section 203. Although not shown, the ribbon take-up shaft, the guide protrusion and the head support shaft 246 are similarly arranged.

When the sheet cartridge 100 is loaded in the cartridge loading section 203, the platen shaft 242 is inserted into a center hole of the platen roller 111 and the platen roller 111 is rotatably supported from below in a cantilevered form. At the same time, the head cover 240 is inserted into the head opening 114, the guide protrusion is inserted into a center hole of the sheet core 104, and the ribbon take-up shaft is inserted into a center hole of the ribbon take-up core 106.

In the apparatus case 201, an insertion opening 251 in which the rib-like protrusion 214 is inserted when the open-close cover 204 is closed is formed to the right side of the cartridge loading section 203. When the open-close cover 204 is closed, the rib-like protrusion 214 is inserted into the insertion opening 251 and actuates a head release mechanism, not shown. By this head release mechanism, as the open-close cover 204 opens and closes, the print head 241 rotates about the head support shaft 246 and moves away from and toward the platen roller 111. That is, when the cover is opened, the print head 241 is away from the platen roller 111, and the label sheet 1 and the ink ribbon 107 can be inserted between the print head 241 and the platen roller 111. When the cover is closed, the print head 241 is close to the platen roller 111, and the label sheet 1 and the ink ribbon 107 are held between the print head 241 and the platen roller 111, thus providing a print standby state.

On a left side portion of the apparatus case 201, a sheet discharge port 252 connecting the cartridge loading section 203 to the outside of the apparatus is formed. Also, on the left side portion of the apparatus case 201, plural lamps 253 indicating ON/OFF of the power source and various setting states are provided. Meanwhile, on a right side portion of the apparatus case 201, an automatic trimmer 254 is provided. Even in the case where printing is carried out on a label portion or tape without round corners, the automatic trimmer 254 can create a label with round corners.

Before the sheet discharge port 252 (downstream in the feeding direction from the print head 241), a sheet cutter 261 (see FIG. 4) which cuts the backing sheet 11 on the rear side of each printed label portion 12 is arranged inside. The sheet cutter 261 is in the form of scissors and includes a fixed blade 263 and a movable blade 264 which are connected at lower ends thereof by a cutter support shaft 262. As the movable blade 264 turns (cuts in) in relation to the fixed blade 263, the label sheet 1 is cut from a lower width end. The sheet cutter 261 is a so-called automatic cutter using a drive motor 271, described later, as a drive source. However, a sheet cutter which is manually operated with an operation lever and the like may also be used. Also, the sheet cutter 261 is not limited to the form of scissors. For example, a sawing-type cutter may also be used. Moreover, a half cutter which cuts only the backing sheet 11 while leaving each label portion 12 in the broad-width area 16 on the label sheet 1 (backing sheet 11) may be provided in addition to the sheet cutter 261.

On the back side of the cartridge loading section 203, between the back side and the base frame 247, a drive motor 271 (see FIG. 8) as a drive source for the feeding operation of the label sheet 1 and the ink ribbon 107 (the rotation of the platen roller 111 and the ribbon take-up core 106) and the cutting operation by the sheet cutter 261, and a power transmission mechanism (not shown) including a gear train and the like that transmits the rotation power of the drive motor 271 to the platen shaft 242 and the like, are arranged inside. When the drive motor 271 rotates forward, the rotation power is transmitted to the platen roller 111 and the ribbon take-up core 106. When the drive motor 271 rotates backward, the rotation power is transmitted to the sheet cutter 261. In this embodiment, the feeding operation of the label sheet 1 and the ink ribbon 107 and the cutting operation by the sheet cutter 261 use the shared drive motor 271 as the drive source. However, as a matter of course, the two operations may use separate drive sources such as separate motors.

An encoder 272 (see FIG. 8) for controlling the feeding amount of the label sheet 1 is fixed to a main shaft of the drive motor 271. Inside the apparatus case 201, a circuit board on which various drivers and a control section 301 (see FIG. 8) are formed, described later, is installed.

Next, the mounting section 230 where the photo sensor 216 is mounted on the open-close cover 204 in such a way that the photo sensor 216 can move slightly in the feeding direction, and the positioning portion 120 for positioning the photo sensor 216 at the detection position in the feeding direction will be described in detail.

As shown in FIGS. 5 to 7, the mounting section 230 is formed as an opening in the cover back-side wall 212 of the open-close cover 204, and has a mounting connection portion 234 which connects a platen-side opening edge portion 232 which is on the platen roller 111 side of the mounting section 230 and a head-side opening edge portion 233 which is on the print head 241 side of the mounting section 230, when the cover is closed.

In the mounting section 230, the photo sensor 216 is mounted in such a way that the longitudinal direction of the sensor substrate 221 of the photo sensor 216 coincides with the feeding direction. In the feeding direction, the mounting section 230 is formed to be slightly longer than the longitudinal dimension of the sensor substrate 221 so that the sensor substrate 221 (photo sensor 216) can move slightly in the feeding direction. Meanwhile, in the direction orthogonal to the feeding direction, the mounting section 230 is formed with a small space from the sensor substrate 221 to such an extent as to allow slight movement of the sensor substrate 221 in the feeding direction. The head-side opening edge portion 233 protrudes to the cover back side further than the platen-side opening edge portion 232. When the cover is closed, the sensor substrate 221 is supported on a top surface of the head-side opening edge portion 233 and a top surface of the mounting connection portion 234.

The photo sensor 216 can slightly move in the feeding direction within a range where each end portion (short-side portion) in the feeding direction of the sensor substrate 221 abuts against each edge portion in the feeding direction of the mounting section 230. This photo sensor 216 is positioned at the detection position in the feeding direction by the positioning portion 120 formed in the sheet cartridge 100.

Figure 3:
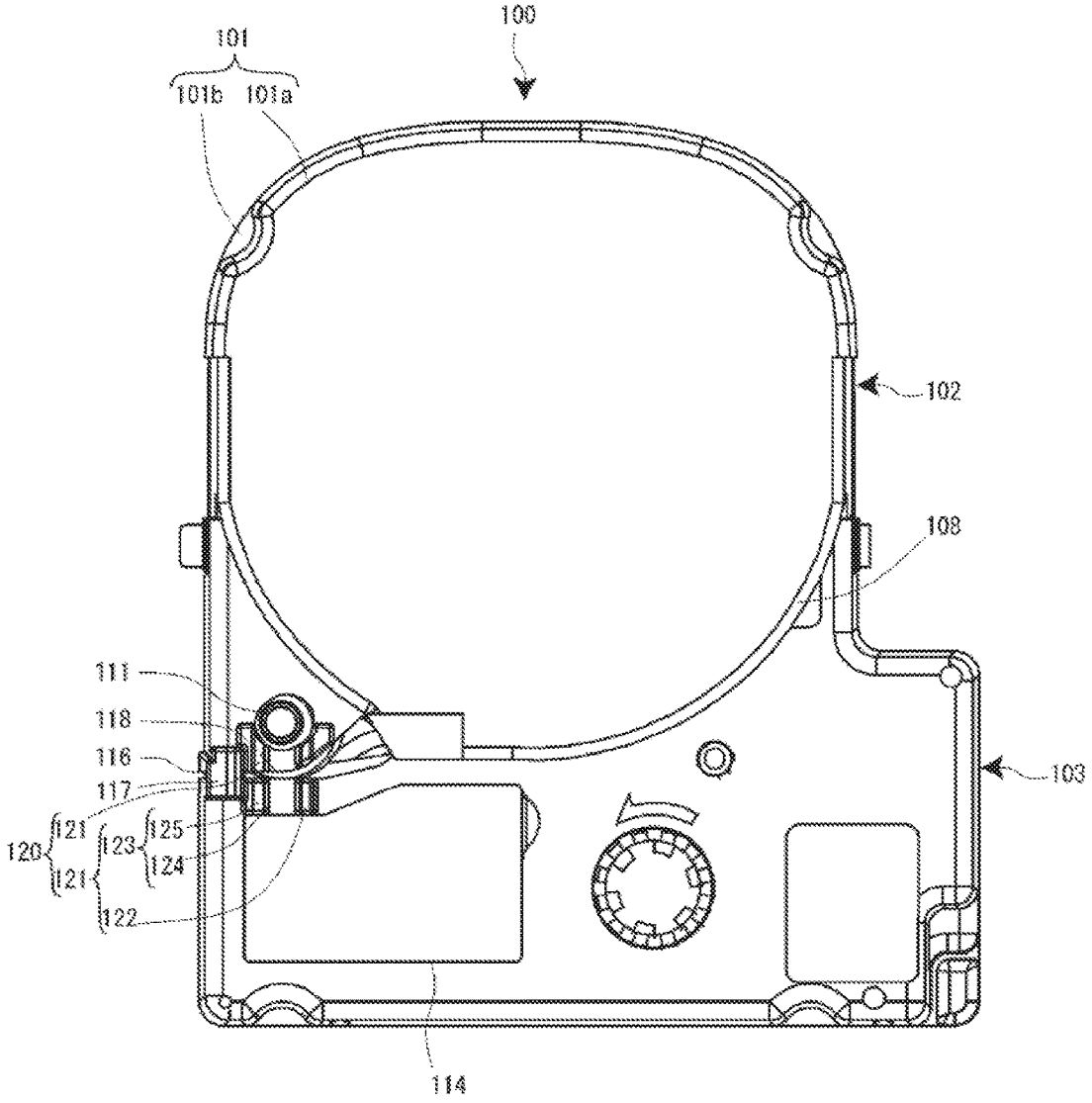
FIG. 3 is a plan view of the sheet cartridge.

As shown in FIGS. 2, 3 and 5, the positioning portion 120 includes a pair of positioning protrusions 121 projected on an edge portion on head opening 114 side of the detection opening 118 and on an edge portion on the platen roller 111 side, respectively, at the position coincident with the platen roller 111 in the feeding direction. Each positioning protrusion 121 is formed in a U-shape with an expanding upper end, and includes an upstream protrusion piece 122 on the upstream in the feeding direction and a downstream protrusion piece 123 on the downstream in the feeding direction. Each of the upstream protrusion piece 122 and the downstream protrusion piece 123 includes a position regulation portion 124 which regulates, in the feeding direction, the position of each end in the feeding direction of each element accommodation section 224 of the sensor case 222, and a width-expanding portion 125 which is connected to an upper end of the position regulation portion 124 and gradually expands in the guide width as it goes upward. As the photo sensor 216 moves downward when the open-close cover 204 is closed, the width-expanding portion 125 guides the photo sensor 216 along the guide surface toward the position regulation portion 124, and the position regulation portion 124 positions each end in the feeding direction of the photo sensor 216 at the detection position in the feeding direction.

In this way, in the label creation apparatus 200, since the positioning portion 120 which positions, at the detection position in the feeding direction, the photo sensor 216 mounted on the open-close cover 204 in such a way that the photo sensor 216 can move slightly in the feeding direction, is provided, even in the case where the open-close cover 204 rotatably mounted on the apparatus case 201 via the hinge mechanism is closed with a misalignment in the feeding direction with respect to the apparatus case 201 (the print head 241 and the sheet cutter 261), the photo sensor 216 can be positioned at the detection position in the feeding direction. Therefore, the start of printing and the cutting with a shift from the planned print start target position 18 and the planned cutting target position 19 due to a misalignment of the open-close cover 204 with respect to the print head 241 and the sheet cutter 261 can be prevented.

Since the photo sensor 216 is positioned simply via the cartridge case 101 with respect to the platen roller 111 as a reference of a print position by the print head 241, the photo sensor 216 can be positioned highly accurately. However, the positioning portion 120 may be formed in other parts than the cartridge case 101. For example, the positioning portion 120 may be formed on a top surface of the head cover 240.

Figure 8:
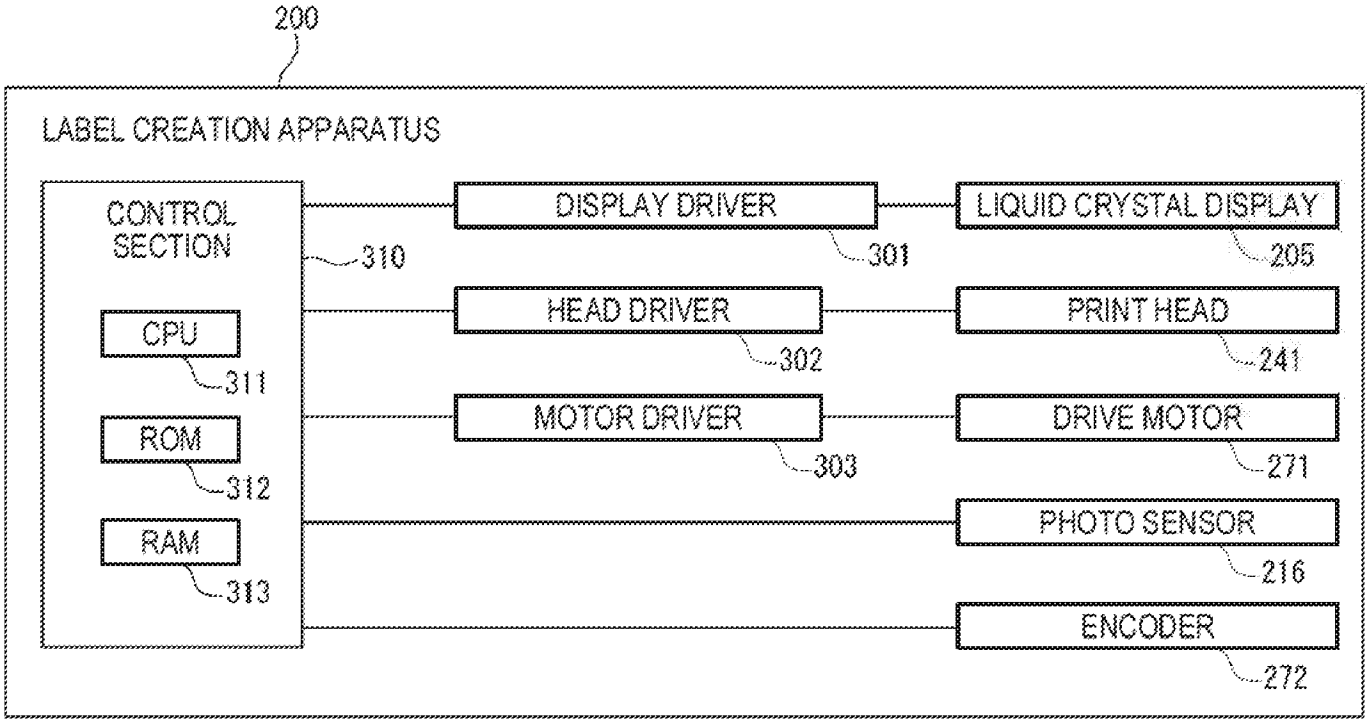
FIG. 8 shows a control block of the label creation apparatus.

Next, the control system of the label creation apparatus 200 will be described with reference to FIG. 8. A display driver 301, a head driver 302, a motor driver 303, and a control section 310 are provided on the circuit board of the label creation apparatus 200. The display driver 301 drives the liquid crystal display 205 and displays the result of input and the like from the keyboard 202, on the liquid crystal display 205. The head driver 302 drives the print head 241. The motor driver 303 drives the drive motor 271 and thus carries out the feeding of the label sheet 1 and the ink ribbon 107 and the cutting by the sheet cutter 261, as described above.

The control section 310 includes a CPU 311 (central processing unit) which carries out various kinds of arithmetic processing, a ROM 312 (read only memory) where a control program and control data used by the CPU 311 to carry out arithmetic processing are stored, a RAM 313 (random access memory) used as a work area when the CPU 311 carries out various kinds of arithmetic processing, and the like. The control section 310 thus controls the entire label creation apparatus 200. As will be described in detail later, the control section 310 controls the drive motor 271 and the print head 241 so that printing on each label portion 12 is started at the planned print start target position 18 and so that cutting is carried out at the planned cutting target position 19, based on the detection of the passage of each label position detection target protrusion 13 by the photo sensor 216 (change in output voltage value). Also, the control section 310 heats and drives the print head 241 based on the number of pulses outputted from the encoder 272, thus synchronizing the driving of the print head 241 with the feeding of the label sheet 1.

A series of operations in the printing and cutting executed by the label creation apparatus 200 will be described with reference to FIGS. 9A to 9E. First, before a print and feed operation on the label sheet 1 is started, the forward end of the label sheet 1 cut at the planned cutting target position 19 in the previous printing and cutting is situated at the sheet cutter 261 (see FIG. 9A). At this point, the photo sensor 216 is situated in the space between label position detection target protrusions 13. Therefore, even if the open-close cover 204 is opened and closed again in this state, the photo sensor 216 is situated in the space between label position detection target protrusions 13. Therefore, when the open-close cover 204 is closed and the photo sensor 216 moves to the detection position, each element accommodation section 224 (see FIG. 7) of the photo sensor 216 does not strike each label position detection target protrusion 13 of the label sheet 1. When the label sheet 1 is sequentially fed, each label position detection target protrusion 13 can be allowed to pass between the pair of element accommodation sections 224 securely.

Next, in the label creation apparatus 200, when an input for print execution is done by the user, the control section 310 drive-controls the drive motor 271 and starts feeding the label sheet 1. When the label sheet 1 is fed by a small amount (for example, 2.5 mm) and the protrusion forward end portion 13*a* of the label position detection target protrusion 13 reaches the photo sensor 216, the photo sensor 216 detects the passage of the protrusion forward end portion 13*a*. Also, at this point, the planned print start target position 18 (label forward end portion 12*a*) is already between the print head 241 and the platen roller 111 (see FIG. 9B). In this way, since the photo sensor 216 need not be provided downstream in the feeding direction from the sheet cutter 261, the distance by which the label sheet 1 is fed until each label position detection target protrusion 13 reaches the photo sensor 216 after the feeding is started (detection feed distance) does not become long. Therefore, the space between the planned cutting target position 19 for each label portion 12 and the planned print start target position 18 for the subsequent label portion 12 (cut-print space) can be reduced. Therefore, the space between label portions 12 can be minimized.

When the control section 310 acquires the detection of the passage of the protrusion forward end portion 13*a* by the photo sensor 216, the control section 310 drive-controls the print head 241 and starts printing at the planned print start target position 18. If the planned print start target position 18 is provided on the rear side from the label forward end portion 12*a* by a predetermined distance (if there is a forward margin), the control section 310, after acquiring the detection of the protrusion forward end portion 13*a*, causes the label sheet 1 to be fed by the predetermined distance and then drives the print head 241, based on the number of pulses outputted from the encoder 272, as described above.

Figure 9A:
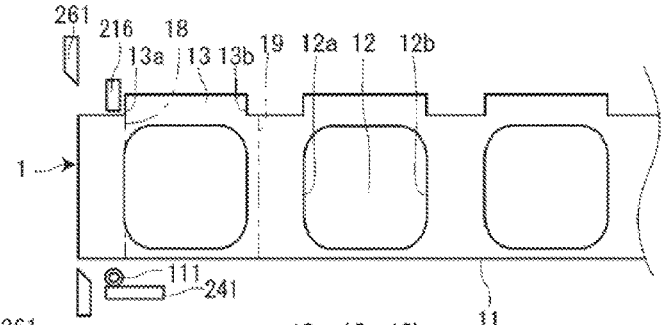
FIGS. 9A to 9E schematically show a flow of printing and cutting in the label creation apparatus.
Figure 9B:
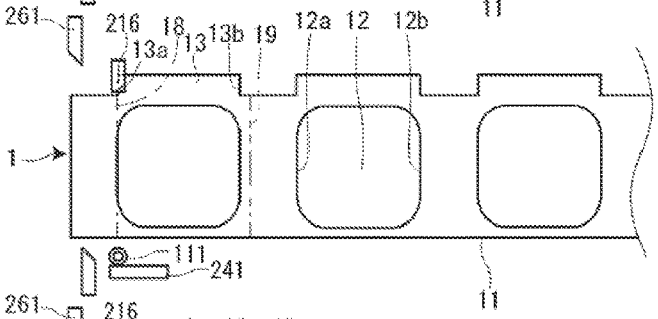
Figure 9C:
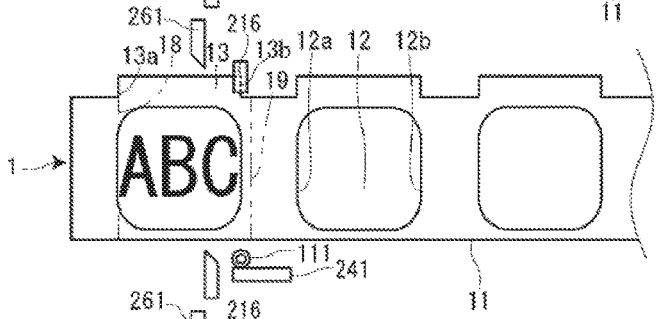
Figure 9D:
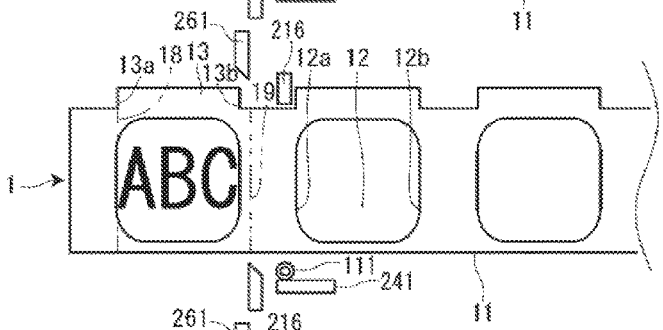
Figure 9E:
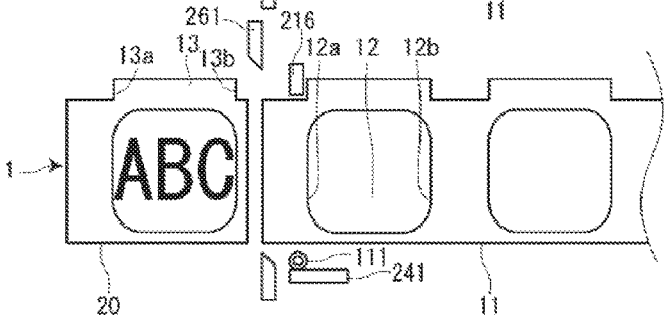

Then, in the label creation apparatus 200, when the printing is completed to the label rear end portion 12*b*, the protrusion rear end portion 13*b* of the label position detection target protrusion 13 reaches the photo sensor 216, and the photo sensor 216 detects the passage of the protrusion rear end portion 13*b* (see FIG. 9C). When the control section 310 acquires the detection of the passage of the protrusion rear end portion 13*b* by the photo sensor 216, the control section 310 causes the platen roller 111 to feed the label sheet 1 by a predetermined distance (for example, 2.5 mm), then stops driving the drive motor 271, and stops feeding the label sheet 1. At this point, the planned cutting target position 19 of the printed label portion 12 is already at the sheet cutter 261 (see FIG. 9D). In this state, the control section 310 drive-controls the drive motor 271 and thus causes the sheet cutter 261 to carry out the cutting. The backing sheet 11 is cut at the planned cutting target position 19. A sheet piece 20 is thus obtained. In this embodiment, the cutting is carried out after one label portion 12 is printed. However, the cutting may be carried out after plural label portions 12 are collectively printed.

As described above, according to the label creation apparatus 200 of this embodiment, since the cut-print space can be reduced (printing can be started immediately behind the cut), printing can be started at the planned print start target position 18 and cutting can be carried out at planned cutting target position 19 with respect to each label portion 12 of the label sheet 1 where the space between label portions 12 is minimized.

Also, the control section 310 not only controls to start printing at the planned print start target position 18 based on the detection of the passage of the protrusion forward end portion 13*a* of each label position detection target protrusion 13 but also controls to cut at the planned cutting target position 19 based on the detection of the passage of the protrusion rear end portion 13*b* after the detection of the passage of the label position detection target protrusion 13. Therefore, the feeding amount by which the label sheet is fed until the planned cutting target position 19 for each label portion 12 reaches the sheet cutter 261 after the detection of the passage of the label position detection target portion can be reduced, compared with the configuration where the photo sensor 216 detects the passage of a single label position detection target portion (for example, only the protrusion forward end portion 13*a*) with respect to each label portion 12. Therefore, even if there is an inconsistency in the feeding amount due to the slipping and the like between the label sheet 1 and the platen roller 111, the amount of shift of the cutting position from the planned cutting target position 19 can be reduced.

Moreover, in the label creation apparatus 200 of this embodiment, the length of the platen shaft 242 can be reduced. That is, for example, in the case where the detection position by the photo sensor 216 is provided near the bottom surface of the cartridge loading section 203, in contrast to this embodiment, the detection target end portion 14 (label position detection target protrusion 13) is fed on the same side (lower side) as the cantilever-support side (lower side). In this case, the platen roller 111 needs to be provided at a position corresponding to each label portion 12 fed on the side (upper side) opposite to the cantilever-support side with respect to the platen shaft 242 and therefore the length of the platen shaft 242 needs to correspond to the full width of the backing sheet 11 (see FIG. 10B).

On the contrary, in this embodiment, the platen roller 111 rotatably supported in a cantilevered form on the platen shaft 242, with a width corresponding to the width of each label portion 12, feeds the label sheet 1 in such a way that the detection target end portion 14 becomes off the platen roller 111 to the side (upper side) opposite to the cantilever-support side (lower side). In this case, the platen roller 111 may be provided at a position corresponding to each label portion 12 fed on the cantilever-support side (lower side) with respect to the platen shaft 242. Therefore, it suffices that the length of the platen shaft 242 corresponds to the width of each label portion 12 (label temporary attachment area 15) (see FIG. 10A), instead of the length corresponding to the full width of the backing sheet 11. Since the length (cantilever distance) of the platen shaft 242 can be reduced in this way, the platen shaft 242 can properly receive a pressing force from the print head 241 without being deformed. Therefore, print quality on each label portion 12 can be stabilized.

Figure 11A:
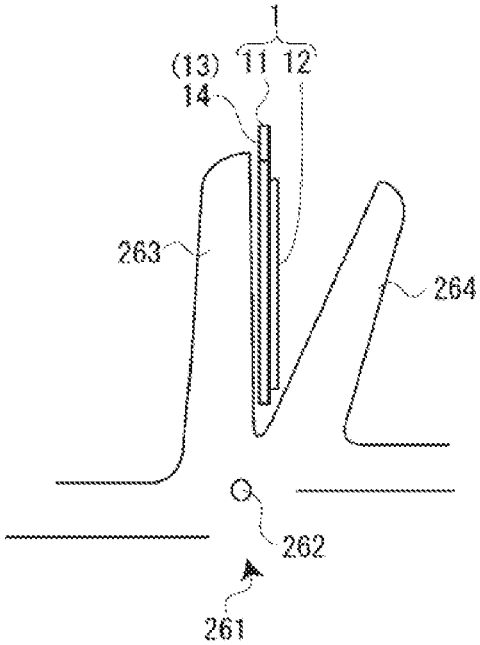
FIG. 11A illustrates the blade length of the sheet cutter of the label creation apparatus according to the embodiment.
Figure 11B:
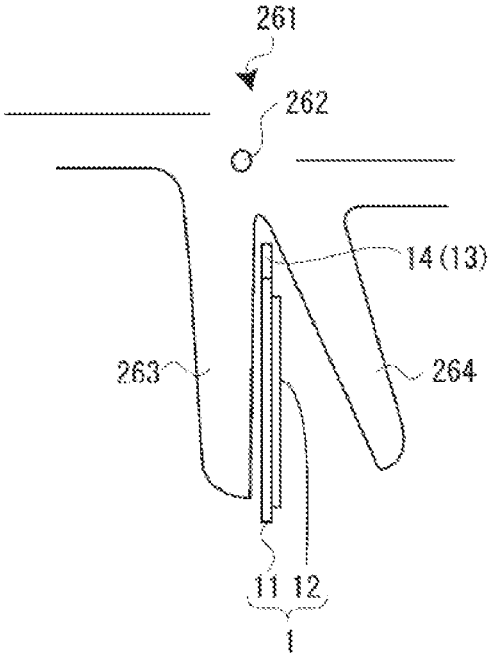
FIG. 11B shows a comparison with FIG. 11A.

Moreover, in the label creation apparatus 200 of the embodiment, the blade length of the fixed blade 263 and the movable blade 264 of the sheet cutter 261 can be reduced. That is, in the case of the configuration where the sheet cutter 261 cuts in from the same side (upper side) as the detection target end portion 14 (label position detection target protrusion 13) of the backing sheet 11, in contrast to the embodiment, if the blade length of the fixed blade 263 and the movable blade 264 of the sheet cutter 261 is the same as in the embodiment, a part is left uncut in the end portion on the side (lower side) opposite to the detection target end portion 14 side of the backing sheet 11 even when the narrow-width area 17 of the backing sheet 11 is cut (see FIG. 11B). Therefore, the blade length of the fixed blade 263 and the movable blade 264 of the sheet cutter 261 needs to be longer.

Meanwhile, in the embodiment, the narrow-width area 17 is the planned cutting target position 19 and the sheet cutter 261 in the form of scissors cuts in from the side (lower side) opposite to the detection target end portion 14 of the backing sheet 11. Therefore, it suffices that the sheet cutter 261 has a blade length corresponding to the narrow-width area 17 (see FIG. 11A). Thus, the blade length of the sheet cutter 261 can be reduced.

What is claimed is:

1. A sheet cartridge comprising:

a label sheet having plural label portions temporarily attached at a predetermined label pitch to a temporary label attachment area that is one end in a direction of width of a long backing sheet, and plural label pyosition detection target portions provided at a detection target end portion that is an other end in the direction of width of the backing sheet and configured to indicate a print start position and a cutting position for each label portion; and a cartridge case which accommodates the label sheet that is wound, in such a way that the label sheet can be reeled off, and in which a detection opening is formed, through which each label position detection target portion protrudes to an outside of the cartridge case for detection, wherein the plural label position detection target portions comprise plural protruding portions formed by projecting the backing sheet in a direction of width of the backing sheet at the detection target end portion, each of the plural protruding portions including a protrusion forward end portion, which indicates the print start position, and a protrusion rear end portion, which indicates the cutting position, and the detection opening is formed in the cartridge case at a position that allows the detection target end portion, that is the other end in the direction of width of the backing sheet, to protrude to an outside of the sheet cartridge through the detection opening while the temporary label attachment area, that is the one end in the direction of width of the backing sheet; remains concealed inside the sheet cartridge.

2. The sheet cartridge according to claim 1, wherein the sheet cartridge is loaded in a cartridge loading section of a label creation apparatus which prints on the label portion, and the detection opening of the cartridge case is provided on the side of an open-close cover that opens and closes the cartridge loading section.

3. The sheet cartridge according to claim 2, wherein a positioning portion for positioning a detection section, which is mounted on the open-close cover in such a way that the detection section can move slightly and which detects the label position detection target portion, is formed in the cartridge case.

4. The sheet cartridge according to claim 3, further comprising a platen roller which is accommodated in the cartridge case and which faces a print head of a printing section of the label creation apparatus via the label sheet provided in-between, wherein the positioning portion is formed in the cartridge case at a predetermined position with respect to the platen roller.

5. The sheet cartridge according to claim 1, wherein each protruding portion is provided at a position coincident with the each label portion in a longitudinal direction of the backing sheet.

6. The sheet cartridge according to claim 1, wherein the protrusion forward end portion and the protrusion rear end portion are provided away from each other in a longitudinal direction of the backing sheet.

7. The sheet cartridge according to claim 1, wherein the protrusion forward end portions of each of the plural protruding portions are disposed substantially perpendicular to the edge of the backing sheet such that each protrusion forward end portion is in alignment with a label leading edge, relative to a direction in which the plural label portions are reeled off of the sheet cartridge, of one of the plural label portions, and the protrusion rear end portions of each of the plural protruding portions are disposed substantially perpendicular to the edge of the backing sheet such that each protrusion rear end portion is in alignment with a label trailing edge, relative to a direction in which the plural label portions are reeled off of the sheet cartridge, of one of the plural label portions.

8. The sheet cartridge according to claim 1, wherein the protrusion forward end portion is a protrusion leading edge of a protruding portion of the plural protruding portions and the protrusion rear end portion is a protrusion trailing edge of the protruding portion of the plural protruding portions, relative to a direction in which the label sheet is fed out of the cartridge case.

9. The sheet cartridge according to claim 8, wherein the protrusion leading edge of each of the plural protruding portions are disposed substantially perpendicular to the edge of the backing sheet such that each protrusion leading edge is in alignment with a desired print start position of one of the plural label portions, and the protrusion trailing edge of each of the plural protruding portions are disposed substantially perpendicular to the edge of the backing sheet such that each protrusion trailing edge is in alignment with a desired cutting position of one of the plural label portions.

10. The sheet cartridge according to claim 8, wherein the label trailing edge of the label portion is separated from the label leading edge of an adjacent label portion by a space such that the label trailing edge of the label portion does not abut the label leading edge of the adjacent label portion.

11. The sheet cartridge according to claim 8, wherein the protrusion leading edge of each protruding portion of the plural protruding portions is in alignment with a label leading edge of a label portion of the plural label portions, and the protrusion trailing edge of each protruding portion of the plural protruding portions is in alignment with a label trailing edge of a label portion of the plural label portions.

12. The sheet cartridge according to claim 1, wherein the detection opening is formed in the cartridge case at a position such that the plural protruding portions protrude to an outside of the sheet cartridge through the detection opening as the label sheet is reeled off.

13. The sheet cartridge according to claim 12, wherein the detection opening is formed in the cartridge case at a position such that the protrusion forward end portion, the protrusion rear end portion, and at least a portion of a first surface of the backing sheet disposed between the protrusion forward end portion and the protrusion rear end portion protrudes through the detection opening as the label sheet is reeled off.

* * * * *